US006010584A

United States Patent [19]

Fonda et al.

[11] Patent Number: 6,010,584

[45] Date of Patent: Jan. 4, 2000

[54] HIGH TEMPERATURE SHAPE MEMORY EFFECT IN RUTHENIUM ALLOYS

[75] Inventors: Richard Fonda; Roy Vandermeer; Harry Jones, all of Alexandria, Va.

[73] Assignee: The United States of America as represented by the Secretary of the Navy, Washington, D.C.

[21] Appl. No.: 08/940,735

[22] Filed: Sep. 30, 1997

[51] Int. Cl.[7] ..... C22C 5/04; C22K 1/00

[52] U.S. Cl. ..... 148/563; 148/402; 420/425; 420/427; 420/462

[58] Field of Search ..... 148/563, 402; 420/425, 427, 462

[56] References Cited

U.S. PATENT DOCUMENTS 5,154,883 10/1992 Fleischer ..... 420/462

FOREIGN PATENT DOCUMENTS 63-235444 9/1988 Japan .

OTHER PUBLICATIONS

Izuno, S., "The Remarkable Shape–Memory Alloys: The Petals Move to the Temperature", *Journal of Electronic Engineering,* v. 20, No. 201, Sep. 1983, pp. 89–93.

*Primary Examiner*—George Wyszomierski

*Attorney, Agent, or Firm*—Thomas E. McDonnell; John J. Karasek

[57] ABSTRACT

The shape memory effect is displayed by near-equiatomic ruthenium alloys of Ta or Nb with compositions of $Ta_xRu_{1-x}$ where x can be as low as 0.38 and preferably x=0.44 to 0.63 and $Nb_xRu_{1-x}$ where x can be as low as 0.25 and preferably x=0.45 to 0.59 which exhibit a transition from the high-temperature cubic phase to a tetragonal phase. These alloys are prepared by melting together tantalum and ruthenium, or niobium and ruthenium, in the above mentioned ratios. A further embodiment of this invention is to alloy NiTi alloys with, one of these two ruthenium-based high-temperature alloys (i.e. either Ta—Ru or Nb—Ru) so as to obtain a similar behavior which will result in an increase in the transition temperature relative to unalloyed Ni—Ti. Articles having the shape memory effect are prepared by forming the alloy into a desired shape above the transition temperature, or alternatively, imparting the desired shape to the alloy below the transition temperature by machining or other shaping processes, and then deforming the alloy into a different shape at a temperature below the transition temperature.

15 Claims, 4 Drawing Sheets

3020°C
L
(Ta)
RuTa
RuTa'
RuTa''
(Ru)
1970°C
1667°C
~38
~39
38
~29
~28
~21
2334°C
WEIGHT PERCENT TANTALUM
ATOMIC PERCENT TANTALUM
TEMPERATURE °C
Ru
Ta

WEIGHT PERCENT RUTHENIUM
ATOMIC PERCENT RUTHENIUM
TEMPERATURE °C
2334°C
2469°C
1942°C
1870°C
~40
1774°C
1540°C
65
71
58
58
75
85
L
(Ru)
(Nb)
NbRu
NbRu'
NbRu3
Nb
Ru

HIGH TEMPERATURE SHAPE MEMORY EFFECT IN RUTHENIUM ALLOYS

BACKGROUND OF THE INVENTION

1. Field of the Invention

This invention relates to near-equiatomic alloys of Ta—Ru and Nb—Ru which exhibit a shape memory effect.

2. Description of the Related Art

The shape memory effect is observed in alloys which undergo a thermoelastic martensitic transformation. This transformation is characterized by the continuous growth of martensite plates as the temperature is lowered and, comparably, the continuous disappearance of these martensite plates as the temperature is subsequently raised. The reversible nature of this transformation can lead to the many interesting features of the shape memory effect. One effect is superelasticity, which occurs above the transformation temperature and consists of the activation of the martensitic transformation in response to an external stress. Any shape changes produced during the transformation are reversed upon release of the external stress. Below the transformation temperature, the material can exhibit a one-way or two-way shape memory effect The one-way shape memory effect exists when the material is deformed below the martensitic transformation temperature and then reverts to its original shape upon heating to above the transformation temperature. With appropriate mechanical and thermal training of the material, this effect can be modified into a two-way shape memory effect. This two-way effect is a reversible shape change which results during both heating and cooling the material through the transformation temperature range.

The shape memory effect was first discovered in NiTi alloys in the early 1960's by W. J. Buehler, J. V. Gilfrich, and K. C. Weiley, *J. Appl. Phys,* 34, 1467 (1963) and by W. J. B ühler and W. B. Cross in *Wire Journal,* 2, 41 (1969). There are now three classes of technically important shape memory alloys: NiTi, Cu—Zn—Al and Cu—Al—Ni. A good review of these materials and their properties is given by J. Van Humbeeck and L. Delaey in their article "A comparative review of the (Potential) Shape Memory Alloys" in *The Martensitic Transformation in Science and Technology*, ed. E. Hornbogen and N. Jost, DGM Informationsgesellschaft, Germany, p 15 (1989). This article shows that all of these alloys have a typical transition temperature near room temperature (i.e. from −200° C. to 170° C.) and can produce typical strains in the polycrystal of 2–4%.

It is possible to raise the transition temperatures of NiTi alloys by the addition of appropriate alloying elements. Some elements which have demonstrated this effect are Au, Zr, Hf, Pt, and Pd, while additions of Co, Fe, Al, and Mg have been shown to decrease the transition temperature. The elements which display the most pronounced effect in raising the transition temperature are Pd as reported by Khatchin et al, *Doklady Akakemii Nauk SSSR,* 257, 167 (1981) and Pt as reported by P. G. Lindquist and C. M. Wayman, *Engineering Aspects of Shape Memory Alloys*, Butterford-Heinemann Ltd, 58 (1990), which can achieve transition temperatures up to 510° C. and 1040° C., respectively, for the binary PdTi and PtTi alloys.

Although there have been a number of earlier publications on near-equiatomic Ta—Ru or Nb—Ru alloys, there has been no mention of the shape-memory behavior in these alloys. Optical microscopy of the phase transformations in these alloys (or at least on the effect of these transformations on previously polished surfaces) was initially performed by Schmerling, Das, and Lieberman in the papers M. A. Schmerling, B. K. Das, and D. S. Lieberman, *Met. Trans,* 1, 3273 (1970); B. K. Das, M. A. Schmerling, and D. S. Lieberman, *Mat. Sci. Eng.,* 6, 248 (1970); and B. K. Das and D. S. Lieberman, *Acta Metall.,* 23, 579 (1975). Although these articles demonstrate the presence of twinning, they attributed this twinning to both the cubic-to-tetragonal and the tetragonal-to-orthorhombic (the orthorhombic phase is actually monoclinic) transformations. Our more recent study, R. W. Fonda and R. A. Vandermeer, "Crystallography and microstructure of TaRu," *Phil. Mag. A,* 76 (1) 119 (1997), showed these twins to be due solely to the cubic-to-tetragonal transformation (in the strain-free state).

Examples of these earlier publications on near-equiatomic Ta—Ru or Nb—Ru alloys which are not described above or elsewhere in this patent are R. L. Fleischer, "High-strength, high-temperature intermetallic compounds," *J. Material Science,* 22, 2281 (1987); P. Greenfield and P. A. Beck, "Intermediate Phases in Binary Systems of Certain Transition Elements," *Trans. AIME*, 206, 265 (1956); E. Raub, and W. Fritzsche, "Die Niob-Ruthenium-Legierungen," *Z Metallk.,* 54, 317 (1963); E. Raub, H. Beeskow, and W. Fritzsche, "Die Struktur der festen Tantal-Ruthenium-Legierungen," *Z Metallk.,* 54, 451 (1963); D. Bender, E. Bucher and J. Muller, "Structure and Electronic Properties of Niobium-Ruthenium Alloys," *Phys. kondens, Materie*, 1, 225 (1963); G. F. Hurley and J. H. Brophy, "A Constitution Diagram for the Niobium-Ruthenium System above 1100° C.," *J. Less-Common Met.,* 7, 267 (1964); B. K. Das, E. A. Stern and D. S. Lieberman, "Displacive Transformations in Near-Equiatomic Niobium-Ruthenium Alloys—II. Energenetics and Mechanism," *Acta Metall.*, 24, 37 (1976); T. Tsukamoto, K. Koyama, A. Oota and S. Noguchi, "Superconductivity and transformation of near-equiatomic M—Ru (M=V, Nb, Ta) alloys," *Cryogenics*, 28, 580 (1988); T. Tsukamoto, K. Koyama, A. Oota and S. Noguchi, "Study of Structural Transformation in Near-Equiatornic M—Ru (M=V, Nb, Ta) Alloys Based on the Electron Theory," *J. Japan Inst. Metals*, 53, 253 (1989); R. L. Freischer, "Intermetallic Compounds for High-Temperature Structural Use", *Platinum Metals Rev.*, 36, 138 (1992); and K. Otsuka and D. Goldberg, "High Temperature Shape Memory Alloys," in *Advances in Science and Technology,* 10 *Intelligent Materials and Systems*, ed P. Vincenzini 55 (1995).

The phase diagrams published by H. Okamoto, "Ru—Ta (Ruthenium-Tantalum)," Binary Alloy Phase Diagram Updating Service, *J. Phase Equilib.*, 12 (3) (1991); B. H. Chen and H. F. Franzen, "Phase Transition and Heterogeneous Equilibrium in the TaRu Homogeneity Range," *J. Less-Common Met.*, 157, 37 (1990); T. B. Massalski, *Binary Alloy Phase Diagrams*, ed. T. B. Massalski, ASM International, p 2758 (1990); and B. H. Chen and H. F. Franzen, "High temperature X-ray diffraction and Landau theory investigation of phase transitions in $NbRu_{1+x}$ and RhTi," *J. Less-Common Met.*, 153,L13 (1989), are quite useful in defining the variation in transition temperatures as a function of composition. However, there has been no mention about the possibility of a shape memory behavior in these alloys.

Previous to our examination, there has only been one report on mechanical tests on these alloys (beyond a crude "chisel toughness" test), which was reported by R. L. Fleischer, R. D. Field, and C. L. Briant, *Met. Trans.* A, 22A, 129 (1991), on compositions of Ta—Ru. In that study, they demonstrated that near-equiatomic Ta—Ru alloys have a room-temperature impact resistance and retain their strengths at elevated temperatures. However, again there has been no mention in this (or other papers) about the possibility of a shape memory behavior in these alloys.

Current commercial alloys such as NiTi, Cu—Zn—Al, and Cu—Al—Ni typically operate near room temperature, and while current research on heavily alloyed NiTi compositions has extended the transition temperatures up to 563° C. and 1040° C. for the (Ni,Pd)Ti and (Ni,Pt)Ti alloys respectively, the Pt alloys are subject to brittleness at higher alloying contents and both alloys are subject to loss of shape memory properties through overheating. NiAl alloys, which have also demonstrated promise for high temperature applications, are currently limited in their application to temperatures below about 300° C. to avoid degradation of properties due to aging. The transition temperatures verified for equiatomic TaRu (1110° C.) according to the present invention are even above these temperatures, confirming TaRu as disclosed herein as the highest transition temperature shape memory alloy yet discovered. There are at present no shape memory effect alloys which operate in the higher temperature regime accessible to the new Ru-based shape memory alloys of this invention.

3. Objects of the Invention

It is an object of this invention to provide a shape memory alloy based on a near-equiatomic composition of ruthenium and either tantalum or niobium.

It is a further object of this invention to provide a shape memory effect alloy that has a higher transition temperature than any other known shape memory alloy.

It is a further object of this invention to provide a shape memory effect alloy based on near-equiatomic composition of ruthenium and either tantalum or niobium in combination with NiTi with significantly increased transition temperature with respect to conventional NiTi alloys.

It is an object of this invention to provide a shape memory effect alloy which has a transition temperature significantly higher than the current commercial alloys such as NiTi, Cu—Zn—Al, and Cu—Al—Ni, which have transition temperatures near room temperature.

It is a further object of this invention to provide a shape memory effect alloy which has a transition temperature higher than 250° C.

It is a further object of this invention to provide a shape memory effect alloy that is not subject to degradation due to overheating.

It is a further object of this invention to provide a shape memory effect alloy that is not subject to degradation due to aging.

These and further objects of the invention will become apparent as the description of the invention proceeds.

SUMMARY OF THE INVENTION

The shape memory effect is displayed by near-equiatomic ruthenium alloys of Ta or Nb with compositions of $Ta_xRu_{1-x}$ where preferably x=0.44 to 0.63 with a phase diagram for these compositions shown in FIG. 1 and $Nb_xRu_{1-x}$ where preferably x=0.45 to 0.59 with a phase diagram for these compositions shown in FIG. 2 which exhibit a transition from the high-temperature cubic phase to a tetragonal phase. Alloys which range in composition down to x=0.25 for $Nb_xRu_{1-x}$ or x=0.38 for $Ta_xRu_{1-x}$ are also believed effective, but these compositions would be less preferred due to the reduced volume fraction of the shape memory phase within those materials. These alloys are prepared by melting together or otherwise combining into an alloy tantalum and ruthenium, or niobium and ruthenium, in the above-mentioned ratios.

A further embodiment of this invention is to alloy NiTi alloys with one of these two ruthenium-based high-temperature alloys (i.e. either Ta—Ru or Nb—Ru) so as to obtain a similar behavior which will result in an increase in the transition temperature relative to unalloyed Ni—Ti.

In the case of the Nb containing alloys, they will have the formula $$[Nb_{(a)}Ru_{(1-a)}]_{(x)}[Ni_{(b)}Ti_{(1-b)}]_{(1-x)}$$

where a=0.4 to 0.65 x=0.001 to 1.000, and b=0.4 to 0.6

In the case of the Ta containing alloys, they will have the formula $$[Ta_{(c)}Ru_{(1-c)}]_{(y)}[Ni_{(d)}Ti_{(1-d)}]_{(1-y)}$$

where c =0.4 to 0.65 y=0.001 to 1.000 and d=0.4 to 0.6

These alloys can be used in a method of preparing an alloy material with a shape memory having a high transition temperature by 1) forming an alloy having the compositions of this invention into a desired shape above the transition temperature or, alternatively, imparting the desired shape to the alloy below the transition temperature by machining or other shaping processes; and 2) deforming the alloy into a different shape at a temperature below the transition temperature.

By heating this alloy material above its transition temperature it reverts back to its original shape.

DESCRIPTION OF THE PREFERRED EMBODIMENTS

Figure 1:
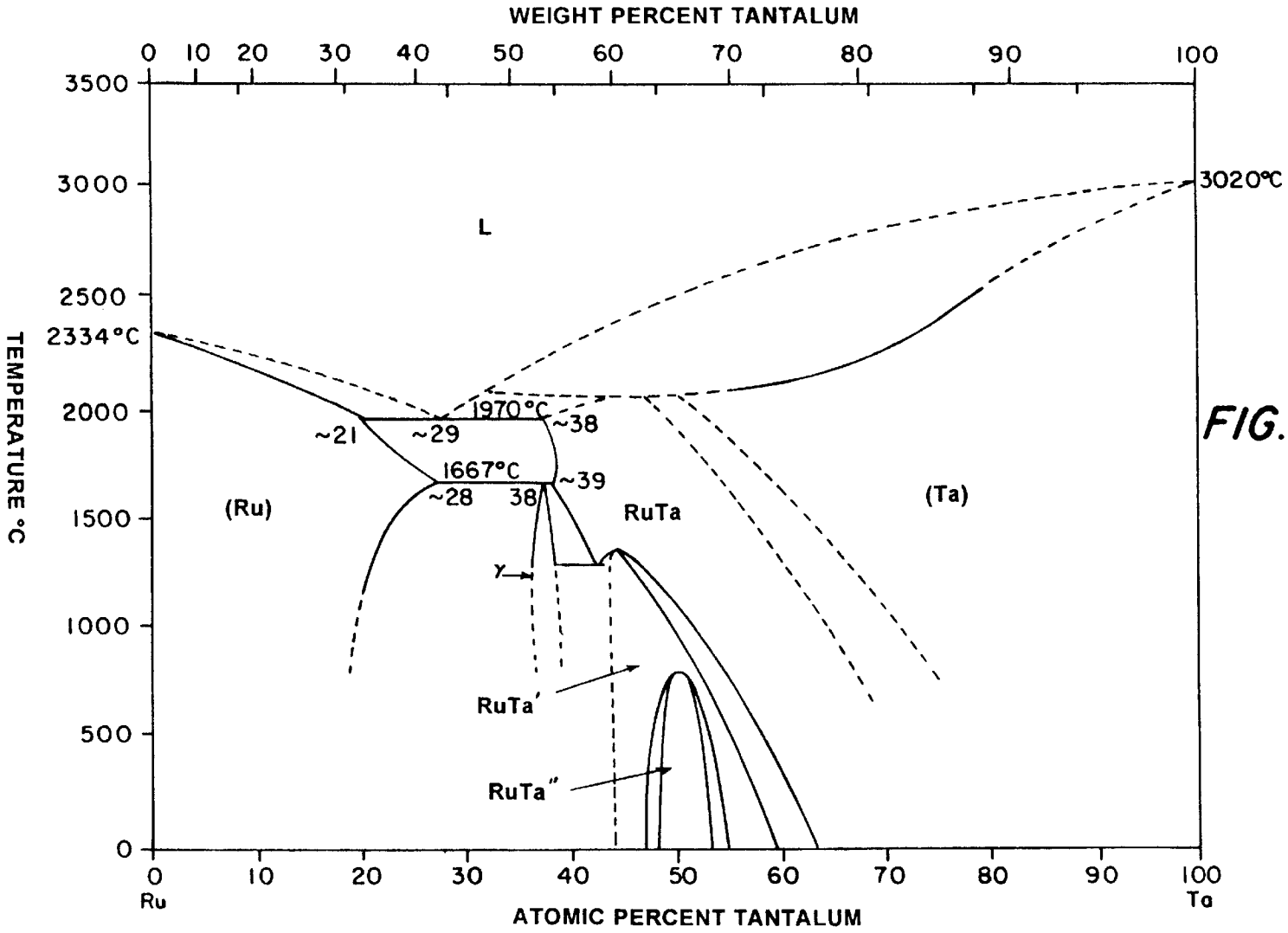
FIG. 1 is a phase diagram of Ru—Ta.

Shape memory alloys are made from a ruthenium alloy of tantalum or niobium having a composition of either $Ta_xRu_{1-x}$ where x is about 0.38 to 0.63 or $Nb_xRu_{1-x}$ where x is about 0.25 to 0.59 which contain a phase which exhibits a shape memory transition from the high-temperature cubic phase to a tetragonal phase.

The maximum shape memory effect should be produced in the alloys with the greatest volume fraction of the phase (or phases) which display the thermoelastic martensitic transition. Thus, while other alloys (or other compositions) may also exhibit some shape memory effect, the dilution of the shape memory phase will reduce the efficacy of the shape memory properties. Therefore, a preferred embodiment is to utilize a single phase material which displays the thermoelastic martensitic transformation. A more preferred composition is a near-equiatomic ruthenium alloy of Ta or Nb with a composition of either $Ta_xRu_{1-x}$ where x is about 0.44 to 0.63 or $Nb_xRu_{1-x}$ where x is about 0.45 to 0.59.

The preferred composition ranges set forth above are meant to reflect the extent of compositions which display the cubic-to-tetragonal phase transition, which is responsible for the shape memory effect. These ranges are defined from the currently available and cited phase diagrams. See FIGS. 1 and 2. It is believed that it may also be possible to produce this phase transition in alloys which range in composition down to x=0.25 for $Nb_xRu_{1-x}$ or x=0.38 for $Ta_xRu_{1-x}$ as set forth above, but these compositions would be less preferred due to the reduced volume fraction of the shape memory phase within those materials.

An even more preferred range of compositions of these alloys are those optimal compositions which will display only the cubic-to-tetragonal phase transition, and will not exhibit further transformation of the tetragonal phase (e.g. to the monoclinic phase). Thus, the more preferred optimal compositions of this invention are defined as x=0.53 to 0.58 for $Nb_xRu_{1-x}$ and both x=0.44 to 0.48 and x=0.54 to 0.63 for $Ta_xRu_{1-x}$. It is expected that these ranges may be extended by alloying.

The list of potential alloying elements is fairly large, the most important of which are B, Al, Ti, V, Cr, Fe, Co, Ni, Zr, Mo, and Hf (and possibly Mo and W as well). Other possible alloying elements are Mg, Sc, Mn, Cu, Zn, Nb, Ru, Rh, Pd, Ag, Ta, Re, Os, Ir, Pt, and Au.

It has previously been demonstrated by P. G. Lindquist and C. M. Wayman "Shape Memory and Transformation Behavior of Martensitic Ti—Pd—Ni and Ti—Pt—Ni Alloys," *Engineering Aspects of Shape Memory Alloys*, ed T. W. Duerig, Butterord-Heinemann Ltd. 58 (1990), that alloying Ni—Ti with other shape memory alloys (i.e. Pd—Ti or Pt—Ti) can result in a series of shape memory alloys with intermediate compositions. The transformation temperatures of these intermediate shape memory alloys initially decreases and then increases as the amount of Pd—Ti or Pt—Ti in the alloy is increased. The shape memory alloys resulting from this alloying exhibited a shape memory effect even when crystallography of the phases giving rise to the shape memory effect differed between the two endpoint shape memory compositions (Ni—Ti and either Pd—Ti or Pt—Ti).

It is a further embodiment of this invention to alloy NiTi alloys with one of these two ruthenium-based high-temperature alloys (i.e. either Ta—Ru or Nb—Ru) so as to obtain a similar behavior which will result in an increase in the transition temperature relative to unalloyed Ni—Ti.

In the case of the Nb containing alloys, they will have the formula $$[Nb_{(a)}Ru_{(1-a)}]_{(x)}[Ni_{(b)}Ti_{(1-b)}]_{(1-x)}$$

where a=0.4 to 0.65 x=0.001 to 1.000, and b=0.4 to 0.6

The basis of this range is that in binary Nb—Ru alloys, the phase transition which has been demonstrated to display the shape memory effect in the comparable TaRu alloys occurs over the composition range of approximately a=0.45 to 0.59, while in binary Ni—Ti alloys, the shape memory effect has been demonstrated in alloys with b=0.47 to 0.53. It is expected this range may be extended by alloying. The preferred embodiments are alloys with a=0.45 to 0.59 and b=0.47 to 0.53.

In the case of the Ta containing alloys, they will have the formula $$[Ta_{(c)}Ru_{(1-c)}]_{(y)}[Ni_{(d)}Ti_{(1-d)}]_{(1-y)}$$

where c=0.4 to 0.65 y=0.001 to 1.000 and d=0.4 to 0.6

Again, the basis of this range is that in binary Ta—Ru alloys, the phase transition which has been demonstrated to display the shape memory effect occurs over the composition range of approximately a=0.44 to 0.63, while in binary Ni—Ti alloys, the shape memory effect has been demonstrated in alloys with b=0.47 to 0.53. It is expected this range may be extended by alloying. The preferred embodiments are alloys with a=0.44 to 0.63 and b=0.47 to 0.53.

Since both Ni—Ti and the two ruthenium based alloys (Ta—Ru and Nb—Ru) are shape memory alloys, an alloy of Ni—Ti with Ta—Ru or Nb—Ru is also expected to exhibit shape memory behavior. Although high Ni—Ti compositions of this quaternary (containing four elements) alloy may actually exhibit a decrease in transition temperature relative to the binary Ni—Ti alloys, the transformation temperature is expected to dramatically increase as the amount of Ni—Ti in the quaternary alloy is reduced. The alloy is free of platinum or palladium and the alloy has a high transition temperature of greater than about 300° C.

Again, the composition ranges quoted are meant to reflect the extent of compositions which display the cubic-to-tetragonal phase transition, which is responsible for the shape memory effect. These ranges are defined from the currently available and cited phase diagrams. Compositions which may give rise to this shape memory phase transition may also extend down to a=0.25 for Nb alloys or c=0.38 for Ta alloys, but these compositions would be less preferred due to the reduced volume fraction of the shape memory phase within those materials.

Figure 2:
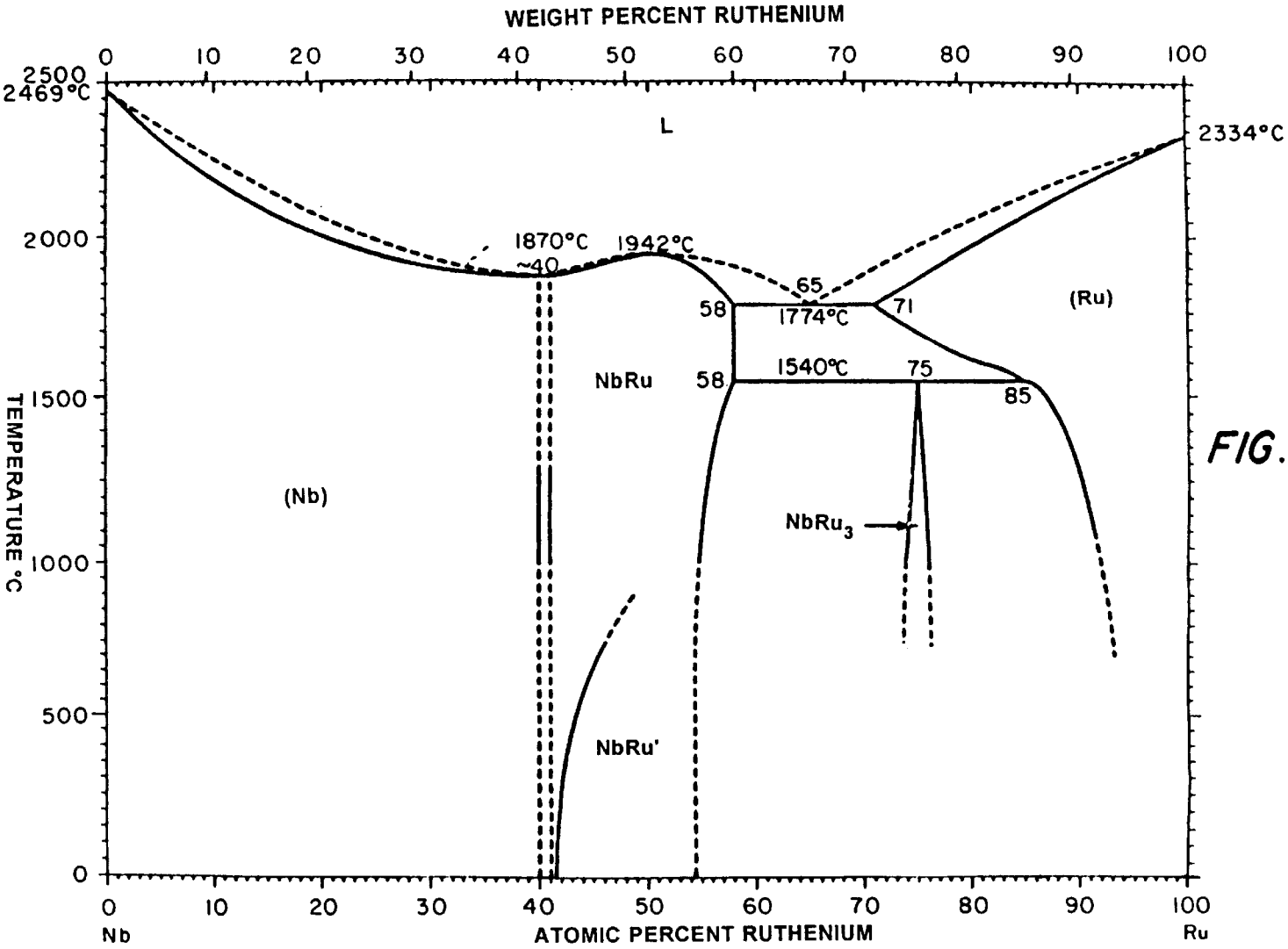
FIG. 2 is a phase diagram of Ru—Nb.

The preferred composition ranges quoted are based on the maximum extent of the tetragonal (β') (NbRu' or TaRu') phase field as presented in the referenced phase diagrams of FIGS. 1 and 2.

The shape memory effect in these alloys is associated with an equilibrium phase transition, and can, therefore, be effectively achieved regardless of the technique used to fabricate the alloy. The technique used to prepare initial samples has been arc-melting.

Specific heat treatments are not required beyond the avoidance of any possible non-equilibrium phases. It is conceivable that such non-equilibrium phases could be produced via extremely fast quenching of the melt, but short of this type of melt-spinning or splat-quenching, the shape memory phases are the expected solidification product.

In contrast to many other shape memory alloys which require thermomechanical treatments to impart the shape memory effect, the compositions of the present invention utilize equilibrium phase transitions to impart the shape memory effect. Thus, there is no requirement for hot or cold working. To make a device or article out of this alloy, there will be a fabrication step to form the alloy into the desired shape, but that could take the form of machining or mechanical deformation. Similarly, to have the alloy return to its original shape it first needs to be deformed from that shape.

Thus the only steps which are necessary are 1) making or obtaining the alloy;

2) forming the alloy into a desired shape above the transition temperature, or alternatively, imparting the desired shape below the transition temperature by machining or other shaping processes;

3) deforming the alloy into a different shape at a temperature below the transition temperature; and 4) reheating the alloy to above the transition temperature to cause it to revert to the original shape.

Although samples produced so far have limited ductility and poor oxidation resistance, it is believed that it may be possible to improve the properties of the alloy (such as ductility, transition temperature, oxidation resistance, recoverable strain, etc.) by the application of appropriate mechanical processing, alloying, and/or coating.

For example, ductility can be improved by alloying with various elements. In particular, alloying with boron has dramatically improved ductility in many other intermetallic systems. Mechanical processing has also been helpful in improving ductility and shape memory behavior in other systems including the NiTi shape memory alloys. Improvements in oxidation resistance may also result from alloying. If alloying does not allow sufficient oxidation resistance for operation of the alloy in the application environment, then coatings will be required.

The primary shape memory transition is associated with the cubic-to-tetragonal phase transformation. The temperature at which this transition occurs ranges from near room temperature, for low ruthenium contents, to about 1400° C. (for the tantalum alloys) or about 1000° C. (for the niobium alloys), with high ruthenium contents of about 55 atomic %. Since the primary shape memory transition corresponds to the cubic (β) (NbRu or TaRu) to tetragonal (β') (NbRu' or TaRu' ) transformation as illustrated in the phase diagrams, the variation in transformation temperature for this transformation is illustrated in both FIGS. 1 and 2 as a function of composition.

Figure 5:
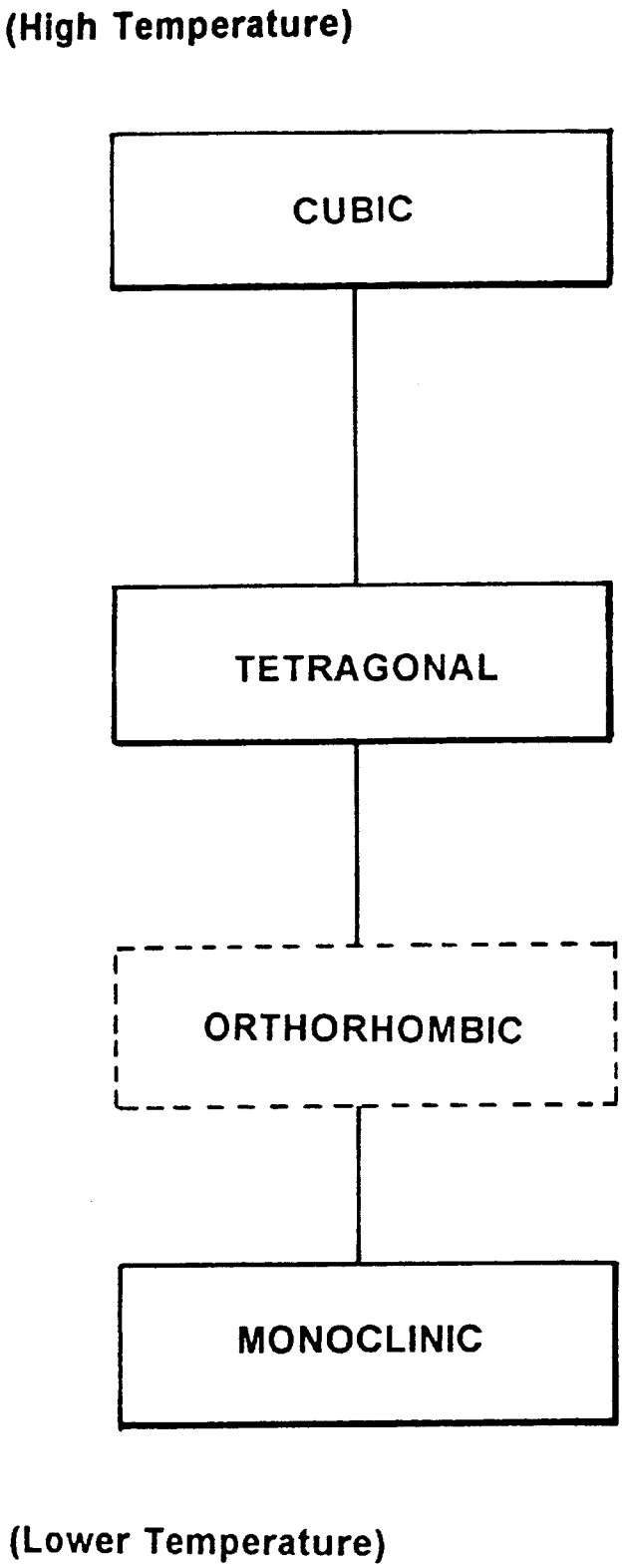
FIG. 5 illustrates the two phase transitions from cubic to tetragonal and from tetragonal to monoclinic for these alloys.

Although another transition from tetragonal to monoclinic as shown in FIG. 5 occurs at lower temperatures for compositions within a few atomic percent of equiatomic, it has been shown not to detract from the shape memory behavior of this high temperature cubic-to-tetragonal transition. Results of mechanical tests indicate that this low-temperature transformation actually enhances the shape memory effect by increasing the possible recoverable strain. This is illustrated in Example 1 where there was an additional recovered strain of about 0.5% from the low temperature (monoclinic-to-tetragonal) transformation. This recoverable strain can be optimized through training, inducing both transitions to produce a strain in a similar direction. It is optimal, however, to completely avoid any additional transitions, because that transition may cause undesired (and unpredictable) shape/dimension changes. The uncertainties inherent in such a complex system would probably prevent any engineer from choosing that material in place of a simpler material which is better understood and more predictable.

The tetragonal-to-monoclinic (β' to β") phase transformation has been demonstrated by R. W. Fonda and R. A. Vandermeer, "Crystallography and microstructure of TaRu," *Phil. Mag. A*, 76 (1) 119 (1997), to consist of two distinct, but concurrent reactions. There is a very rapid transformation of the tetragonal crystal structure which is revealed by both dilatometry and by in-situ high-temperature transmission electron microscopy. This rapid transformation occurs over a temperature range of approximately 20° C. However, electrical resistivity measurements and in-situ high-temperature observation of electron microdiffraction patterns in the transmission electron microscope reveal another transformation which occurs over a range of about 200° C. This transformation consists of an internal rearrangement of atoms which reduces the symmetry of the product phase to a monoclinic symmetry. There is thus strong evidence of a transitional or metastable orthorhombic phase which is produced transiently during the tetragonal-to-monoclinic transformation of these equiatomic alloys. While this orthorhombic phase has not been directly observed in the equiatomic TaRu and NbRu alloys, it may be possible to stabilize the orthorhombic phase as a transformation product with a different stoichiometry (binary alloy composition) and/or by alloying. Therefore, the orthorhombic phase will be discussed as a potential intermediate phase which is a transformation product of the tetragonal phase and which may, in turn, transform to the monoclinic phase.

Although the initial work has concentrated on Ta—Ru alloys, the Nb—Ru alloys are also considered important because they promise to have about ⅔ the density and to be much more chemically homogeneous.

Confirmation of the shape memory effect in Nb—Ru alloys has not yet been accomplished, but the similarities between these two alloy systems in crystallography, microstructure, and transformation behavior implies a similar mechanical behavior which includes the shape memory effect.

These newly discovered unique shape memory effect alloy compositions (Ta—Ru and Nb—Ru) have already exhibited transition temperatures far in excess of the shape memory transition temperature of any previously reported shape memory effect alloy. The transition temperature of about 1120° C. was measured for the high-temperature transformation in equiatomic Ta—Ru, and shape recovery of a Ta—Ru sample deformed in compression occurred between this temperature and about 1400° C. as will be seen in FIG. 3 which is described in Example 1. The transition temperatures of the high-temperature transformation in equiatomic Nb—Ru was measured to be only slightly lower, 885° C.

The reported variation in the cubic-to-tetragonal transition temperature, which corresponds to the shape memory transition temperature, with changes in composition indicate that the transition temperature of these alloys can be made to vary between room temperature (or below) and 1400° C., for the Ta—Ru alloys, or 1000° C., for the Nb—Ru alloys. The presence of the shape memory effect in the near-equiatomic alloys of Ta—Ru and Nb—Ru is a heretofore unknown property.

FIG. 5 illustrates the two main transitions with reference to the orthorhombic phase as a potential intermediate phase as discussed previously. The cubic to tetragonal transition occurs at the higher temperature and results in a microstructure which is highly twinned. Then, in the lower temperature transition from tetragonal to monoclinic, fine boundaries called delta-boundaries are produced which relate regions which have undergone different variants of the slight monoclinic distortion. These fine delta-boundaries have the appearance of antiphase domain boundaries and exhibit a similar contrast in the transmission electron microscope, but electron microdiffraction reveals that the crystals on either side of the boundary have different crystallographic orientations. In this case, the tetragonal crystal structure only undergoes a slight distortion as it transforms to the monoclinic crystal structure. Thus, when a single tetragonal crystal transforms to form two different regions (different orientation variants) of monoclinic crystal, those regions are separated from each other by a delta boundary.

The near-equiatomic alloys of Ta—Ru and Nb—Ru exhibit a shape memory effect and as such can be used in a variety of devices which require a reversible shape change. The primary utility of these alloys would be as sensors, actuators, fasteners, and vibration dampeners which can operate in elevated temperature environments. Some potential elevated temperature environments are in or near engines of aircraft or automobiles and in the high-temperature chemical industry. Many high-temperature applications require a higher transition temperature than is commercially available, and there are only a few experimental shape memory alloys which have a demonstrated shape memory transition above 300° C. The Ta—Ru and Nb—Ru alloys have some potential advantages over these experimental alloys, and most notably the fact that they are comprised of equilibrium phases with equilibrium phase transformations, and are therefore not subject to the overheating or aging effects which can be experienced by the metastable shape memory phases of those experimental alloys. High-temperature shape memory alloys can also have utility in low- or moderate-temperature applications where a fast recovery time is required. Because of the very large temperature difference between the activated shape memory device (above the transition temperature) and the surrounding environment, a high-temperature shape memory alloy is likely to cool through its shape memory transition faster than a low-temperature shape memory alloy.

Having described the basic aspects of the invention, the following examples are given to illustrate specific embodiments thereof.

EXAMPLE 1

This example illustrates the shape memory effect of a TaRu sample which undergoes compression and recovery of that strain.

Figure 3:
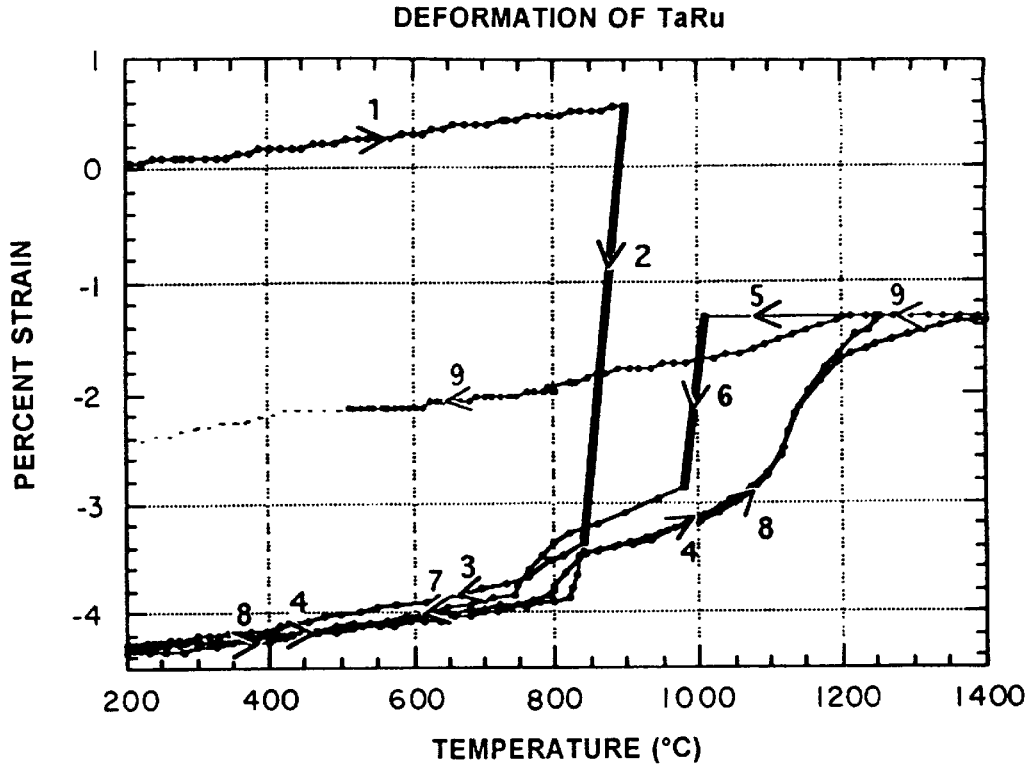
FIG. 3 illustrates the shape memory effect of TaRu by showing the deformation history of the TaRu strained in compression.

The deformation history of an equiatomic 50%Ta-50%Ru alloy used in this example is given in FIG. 3. First, the sample was heated to 900° C. (arrow 1). Then the sample was deformed about 4% at 900° C. (arrow 2). The sample was then cooled to room temperature (arrow 3). The next treatment was to reheat the sample to 1250° C. (arrow 4). The reheating of the sample to 1250° C. demonstrates three concepts. First, the strain recovery of the sample was not complete at 1250° C., but requires higher temperatures. This is evident from the continued upward slope (in excess of the slope of the coefficient of thermal expansion which is shown on the bottom plot of the dilatometry of the TaRu) of this reheating curve up to the temperature of 1250° C. Second, most of the strain is recovered at the high temperature transition of tetragonal-to-cubic which is occurring between 1100° C. and 1200° C. and this transition is seen in the TaRu phase diagram in FIG. 1. This transformation recovered about 1.5% of the introduced strain from a value of −3% strain to −1.5% strain . Third, the low temperature (monoclinic-to-tetragonal) transformation which occurs from 810 to 820° C. is responsible for introducing about 0.5% in additional recoverable strain during cooling; this strain was fully recovered during the subsequent heating cycle (arrow 4).

The sample was then cooled to 1,000° C. (arrow 5) and it was deformed an additional 1.5% while maintained at approximately 1,000° C. (arrow 6). Next the sample was cooled to room temperature (arrow 7). The shape recovery during this second reheating roughly paralleled that observed during the first thermomechanical cycle.

In the final treatment, the sample was reheated to 1400° C. (arrow 8), during which similar strain recovery was again observed. Finally, the sample was cooled to room temperature (arrow 9).

This test was performed on a sample which was about 1 cm long, which is comparable to the grain size. This small sample size facilitates the experimental work because it takes a shorter time for the sample to cool through these large temperature changes. However, larger sample to grain size ratios of polycrystalline materials will better average over all the grain types and this average may have significantly better or even somewhat worse shape recovery properties.

EXAMPLE 2

This example illustrates the shape memory effect of a TaRu sample which undergoes recovery from bending produced during a 3-point bending test.

Figure 4:
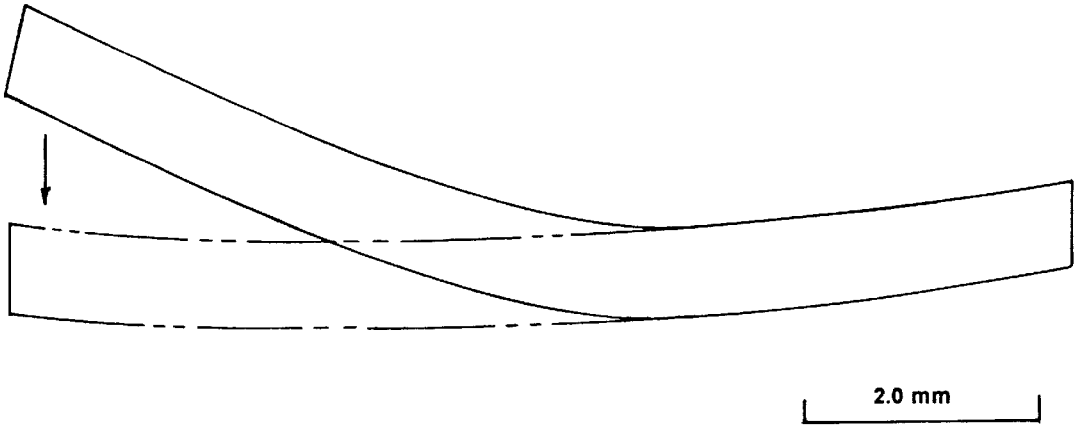
FIG. 4 illustrates the shape memory effect of TaRu in bending by a schematic superposition of a bar in a 3-point bend test sample before and after shape recovery.

A test sample of the same alloy of Example 1, an equiatomic 50%Ta-50%Ru alloy, was bent in a 3-point bend test under an inert gas (nitrogen) atmosphere at 950° C. After release of the stress and cooling to room temperature the bending angle was measured as 29°. It is assumed that this angle was representative of the strain introduced (i.e. that any variation in this angle during cooling through the low temperature transformation was small). A schematic of this bar is set forth in FIG. 4.

The sample was then heated to 1420° C. and the amount of bend decreased to an angle of 11° due to the shape recovery during the reheating of the sample. A schematic of the sample in this condition (after recovery), is superimposed over a schematic of the initial bent condition in FIG. 4. These two images clearly demonstrate the shape memory effect in the bending of Ta—Ru and show that the shape memory effect is present in tension as well as compression..

It is understood that the foregoing detailed description is given merely by way of illustration and that many variations may be made therein without departing from the spirit of this invention.

What is claimed is:

1. A shape memory alloy comprising at least 50% in total of ruthenium and niobium and having a composition of $Nb_xRu_{1-x}$ where x is about 0.25 to 0.59 in atomic ratio which contain a phase which exhibits a shape memory transition from a high-temperature cubic phase to a tetragonal phase.

2. A shape memory alloy according to claim 1, comprising a near-equiatomic ruthenium alloy of niobium having a composition of $Nb_xRu_{1-x}$ where x is about 0.45 to 0.59
which exhibits a shape memory transition from the high-temperature cubic phase to a tetragonal phase.

3. A shape memory alloy according to claim 2, having a composition of $Nb_xRu_{1-x}$ where x is about 0.53 to 0.58
which exhibits a shape memory transition from the high-temperature cubic phase to a tetragonal phase without a further transformation to a low-temperature monoclinic phase during cooling to room temperature.

4. A shape memory alloy according to claim 2, having a composition of $Nb_xRu_{1-x}$ where x is about 0.45 to 0.59

5. An article made of shape memory ruthenium-based alloy according to claim 1, comprising a near-equiatomic ruthenium alloy of niobium having a composition of $Nb_xRu_{1-x}$ where x is about 0.25 to 0.59
which exhibits a shape memory transition from the high-temperature cubic phase to a tetragonal phase.

6. An article made of shape memory ruthenium-based alloy comprising a near-equiatomic ruthenium alloy of niobium according to claim 5, having a composition of $Nb_xRu_{1-x}$ where x is about 0.45 to 0.59
which exhibits a shape memory transition from the high-temperature cubic phase to a tetragonal phase.

7. An article made of a shape memory alloy comprising a near-equiatomic ruthenium alloy of niobium according to claim 6, having a composition of $Nb_xRu_{1-x}$ where x is about 0.53 to 0.58
which exhibits a shape memory transition from the high-temperature cubic phase to a tetragonal phase without a further transformation to a low-temperature monoclinic phase during cooling to room temperature.

8. An article made of a shape memory alloy comprising at least 50% of a near-equiatomic ruthenium alloy of niobium according to claim 6, having a composition of $Nb_xRu_{1-x}$ where x is about 0.45 to 0.59
which is alloyed with one or more of B, Mg, Al, So, Ti, V, Cr, Mn, Fe, Co, Ni, Cu, Zn, Zr, Nb, Mo, Ru, Rh, Pd, Ag, Hf, Ta, W, Re, Os, Ir, Pt, and Au and which exhibits a shape memory transition from the high-temperature cubic phase to a tetragonal phase.

9. A method of producing a shape memory effect alloy comprising a near-equiatomic ruthenium alloy of niobium with a composition of $Nb_xRu_{1-x}$ where x is about 0.25 to 0.59 in atomic ratio which exhibits a shape memory transition from a high-temperature cubic phase to a tetragonal phase by combining ruthenium with niobium to form an alloy of the specified composition.

10. A method according to claim 9, wherein the composition is $Nb_xRu_{1-x}$ where x is about 0.45 to 0.59.

11. A method of preparing a shape memory alloy comprising the steps of:

1) forming an alloy having the composition of $Nb_xRu_{1-x}$ where x is about 0.25 to 0.59 in atomic ratio into a desired shape above a transition temperature, or alternatively, imparting the desired shape to the alloy below the transition temperature by a shaping process; and 2) deforming the alloy into a different shape at a temperature below the transition temperature.

12. A method according to claim 11, wherein the composition is $Nb_xRu_{1-x}$ where x is about 0.45 to 0.59.

13. A method of utilizing a shape memory alloy comprising reheating the alloy made by the process of claim 12 to above the transition temperature to cause it to revert to the original shape.

14. A method according to claim 11, wherein the alloy is free of platinum or palladium and the alloy has a high transition temperature of greater than about 300° C.

15. A method of utilizing a shape memory alloy comprising reheating the alloy made by the process of claim 11 to above the transition temperature to cause it to revert to the original shape.

* * * * *